United States Patent [19]

Blanc et al.

[11] Patent Number: 4,741,062

[45] Date of Patent: May 3, 1988

[54] LAST FOR AUTOMATED SHOE MANUFACTURE

[76] Inventors: Roger Blanc, Route de Virieu, Le Pin, 38730 Virieu sur Bourbre; Jean Kessler, La Joncere, 38137 Paladru, both of France

[21] Appl. No.: 918,000

[22] Filed: Oct. 10, 1986

[51] Int. Cl.[4] ..... A43D 3/00; A43D 25/00

[52] U.S. Cl. ..... 12/133 R; 12/1 A; 211/34

[58] Field of Search ..... 12/1 A, 1 R, 1 W, 128 R, 12/133 R, 133 B, 133 C, 139–141, 52.5, 123; 211/34–37

[56] References Cited

U.S. PATENT DOCUMENTS

| | | | |
|---|---|---|---|
| 1,032,805 | 7/1912 | Batchelder | 12/128 R |
| 1,703,190 | 2/1929 | Glidden | 211/34 |
| 2,111,512 | 3/1938 | Naceski | 12/133 R |
| 2,806,233 | 9/1957 | Hubbard et al. | 12/133 R |
| 3,076,213 | 2/1963 | Makovski et al. | 12/133 R |
| 3,881,205 | 5/1975 | Funck | 12/133 R |
| 4,286,348 | 9/1981 | White, Sr. | 12/133 R |
| 4,639,963 | 2/1987 | Fisher | 12/1 A |

FOREIGN PATENT DOCUMENTS

| | | | |
|---|---|---|---|
| 0751394 | 7/1980 | U.S.S.R. | 12/1 A |

*Primary Examiner*—Steven N. Meyers

*Attorney, Agent, or Firm*—Karl F. Ross; Herbert Dubno

[57] ABSTRACT

A last has an insert shaped to fit within a shoe during its manufacture and a stem fixed on the insert, projecting along an axis from the insert, and formed with radially oppositely projecting front and rear protrusions. A gripper has front and rear jaws formed with respective recesses complementarily engageable with the protrusions so it can accurately hold and position the shoe and last. The protrusions and recesses are formed substantially entirely of planar surfaces, although they can be complementarily rounded, for instance part-spherical. The stem has a radially directed flat provided with indicia and the gripper is provided with a scanner juxtaposable with the flat for reading the indicia. A stationary card on the flat carries the indicia.

6 Claims, 2 Drawing Sheets

LAST FOR AUTOMATED SHOE MANUFACTURE

FIELD OF THE INVENTION

The present invention relates to a last for the manufacture of a shoe. More particularly this invention concerns a system incorporating a last for the robot-type automated manufacture of footwear.

BACKGROUND OF THE INVENTION

A shoe is invariably manufactured on a last which is a rigid form having dimensions corresponding exactly to the internal size and shape of the shoe being made, that is of standard foot shape and corresponding to either a right or left foot of a predetermined standard length and width. The vamp and sole are built up in stages on this last which is not normally removed until the shoe is 100% complete.

For the standard manual manufacture of footwear the last has a very short stem projecting from the top of the shoe and formed with a bore open perpendicular to the shoe sole. Each station of the manufacturing chain is provided with a peg that fits complementarily into this bore to hold the last and the partially manufactured shoe in a predetermined position for whatever steps are to be carried out at that station. The partial finished shoes are typically put on.and taken off these pegs with their lasts manually and can be transported by a belt or similar system from station to station.

Adaptation of such lasts to a robot-type of automatic manufacture has not yielded satisfactory results. The peg mounting is not sufficiently accurate to ensure sufficiently precise positioning of the shoe and last to allow automatic machinery to work on the shoe. In addition the automatic equipment must be able to ascertain what type, size, or side (right or left) the shoe is for, so that the equipment, even if partially automated, must be loaded and worked with in large part by hand.

OBJECTS OF THE INVENTION

It is therefore an object of the present invention to provide an improved last.

Another object is the provision of such a last which overcomes the above-given disadvantages, that is which can be used in combination with a robot arm which is also part of the invention to facilitate the robot-type automatic manufacture of footwear.

SUMMARYOF THE INVENTION

These objects are attained according to this invention in a system comprising a last having an insert shaped to fit within a shoe during its manufacture and a stem fixed on the insert, projecting along an axis from the insert, and formed with radially oppositely projecting front and rear protrusions, and a gripper having front and rear jaws formed with respective recesses complementarily engageable with the protrusions.

According to this invention the protrusions and recesses are formed substantially entirely of planar surfaces, although it is within the scope of the invention for them to be complementarily rounded, for instance part-spherical.

In accordance with a further feature of this invention the stem has a radially directed flat provided with indicia and the gripper is provided with means juxtaposable with the flat for reading the indicia. A stationary card on the flat carries the indicia.

Furthermore according to the invention the stem is provided with a seat to fit with a rack and having a formation complementarily engageable with the seat for holding and positioning the last and shoe. This seat and the formation are formed substantially entirely of planar surfaces.

For use of the last of this invention in a conventional system the stem is formed with an axially upwardly open hole.

DESCRIPTION OF THE DRAWING

The above and other features and advantages will become more readily apparent from the following, reference being made to the accompanying drawing in which.

SPECIFIC DESCRIPTION

Figure 1:
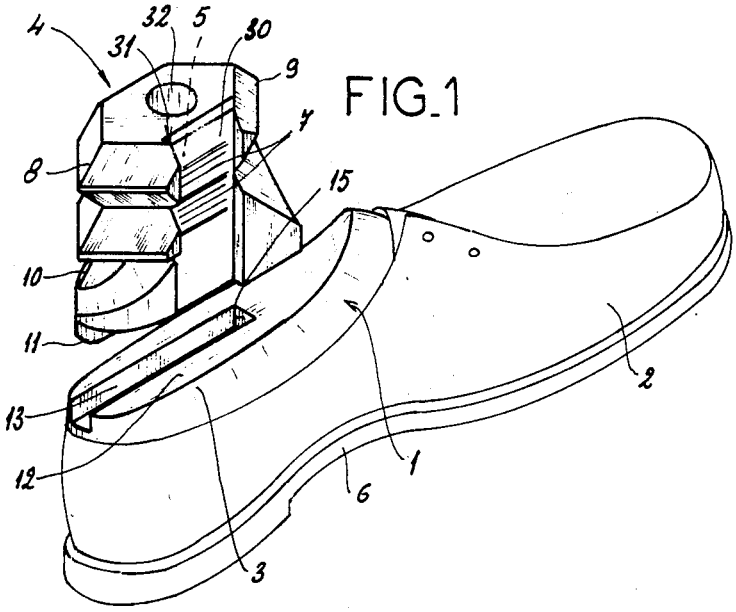
FIG. 1 is an exploded perspective view of the last according to this invention carrying a partially manufactured shoe.
Figure 2:
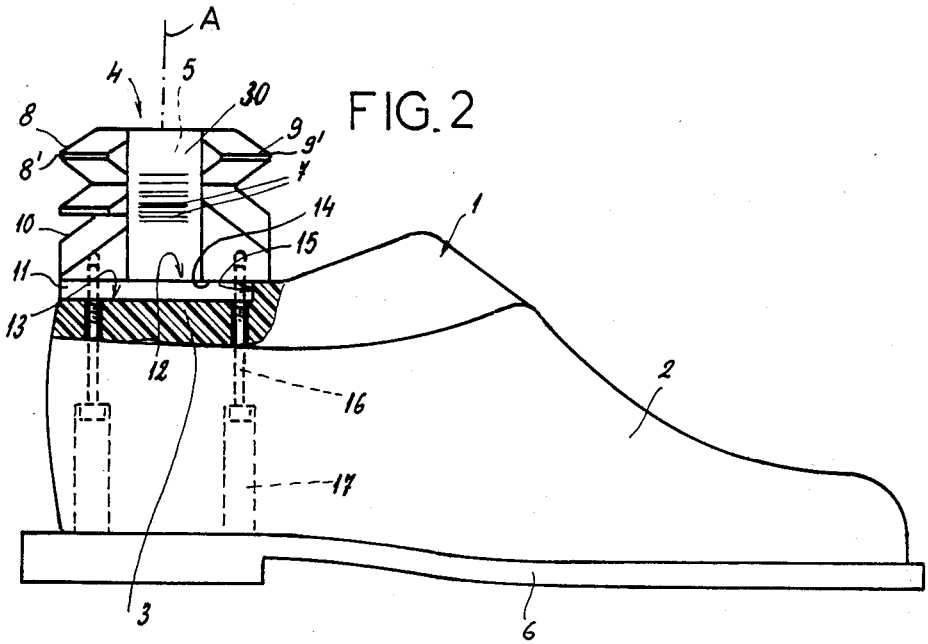
FIG. 2 is a side view partly in section showing the last and shoe of FIG. 1.

As seen in FIGS. 1 and 2 a last 1 is used to manufacture a shoe 2 and basically comprises a standard molded shoe insert 3 and a stem 4 rigidly connected thereto as described below.

This stem 4 extends along an axis A itself perpendicular to the sole 6 of the shoe 2 and is formed with a laterally open slot 5 extending parallel to this axis A. The rear of the stem 4 is formed with a radially and backwardly projecting and pointed formation 8 and the front of the stem 4 with an identical front projection 9. Each of these projections 8 and 9 is formed by four identical planar surfaces meeting at backwardly and forwardly directed points 8′ and 9′. Except for the slot 5 the stem 4 is symmetrical about a plane including the axis A and bisecting the points 8′ and 9′. In addition the rear of the stem 4 is formed axially below the projection 8 with a rearwardly open notch or seat 10.

The bottom surface 14 of the stem 4 is planar and fits flatly on a planar upper surface 12 of the insert 3. An axially downwardly projecting square-section ridge 11 fits in a complementary slot 13 formed in this surface 12 and against a rearwardly directed face 15 of this slot 13, thereby accurately defining the position of the stem 4 on the insert 3. This insert is formed with two counterbores 17 through which respective screws 16 engage axially into the bottom of the stem 4 through the ridge 11.

Figure 2A:
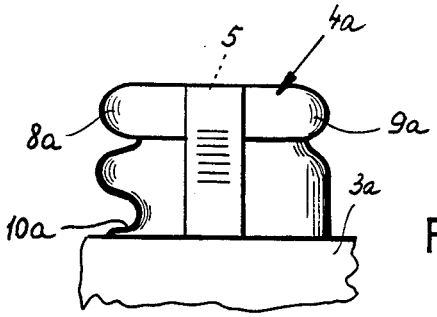
FIG. 2A is a side detail view of a variant on the system of this invention.

The system of FIG. 2A has semispherical bumps 8*a* and 9*a* replacing the angular protrusions 8 and 9 of FIGS. 1 and 2 and a semispherical recess or seat 10*a* replacing the angular seat 10. In addition this stem 4*a* is unitarily formed of a synthetic resin with the insert 3*a*.

In a manufacturing operation all of the stems 4 will be absolutely identical but the inserts 3 will, of course, be different. The slot 5 is formed with a pair of guides 31 adapted to hold a stiff code tag 30 bearing indicia 7, here a bar code that identifies the particular insert 3.

The top surface of the insert 4 is also formed centered on the axis A with a cylindrical blind bore 32 that allows the last 1 to be set in a convention peg-type support.

Figure 3:
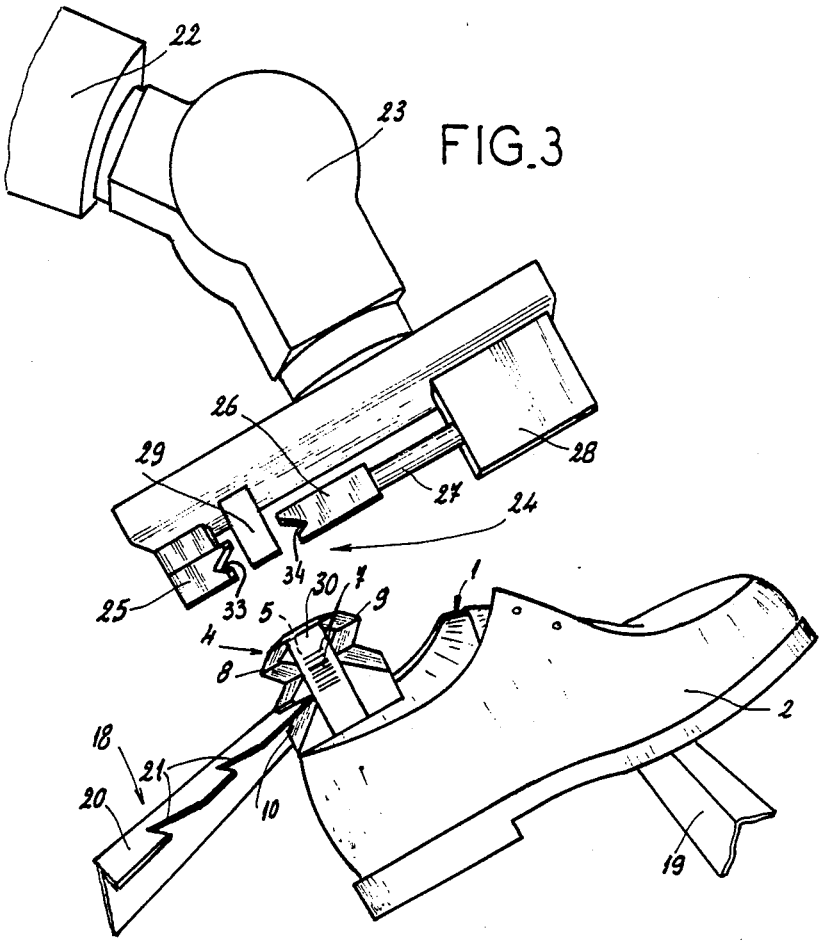
FIG. 3 is a perspective view illustrating the last and shoe of this invention supported on a rack adjacent the end of a robot arm.

As seen in FIG. 3 the shoe 2 fitted with the last 1 according to the invention is held between production steps on a rack 18 comprised of a front angle-iron rail 19 and a rear angle-iron rail 20 normally extending parallel to each other with the rear rail 20 slightly above the front rail 19. The front rail 19 is of regular uninterrupted section and has a vertical rear flange and a horizontal and forwardly directed front flange. The rear rail 20 is similarly oriented, but its upper flange is tilted somewhat upward and is formed with a row of equispaced and forwardly flared notch formations 21 complementary to the seat 10 of the stem 4. Thus the rack 18 can support a row of shoes 2 in lasts 1 in an exact orientation.

A robot arm 22 has an outer end 23 provided with a gripper 24 comprised of a rear fixed jaw 25 and a front movable jaw 26. These jaws 24 and 25 have respective faces 33 and 34 that are forwardly and rearwardly concave and complementary to the projections 8 and 9 (or to the projections 8a and 9a of FIG. 2A). The front jaw 26 is carried on the rod 27 of a double-acting cylinder 28 so that the jaws 25 and 26 can be closed on the stem 4 to hold it very solidly in a position that will be extremely accurate. In addition the arm end 23 carries a bar-code reader 29, typically with 8 sensors, that is juxtaposed with the code 7 when the stem 4 is gripped between the jaws 25 and 26.

Thus the shoe 2 and last 1 will be fairly accurately positioned by the rack 18. The robot arm 22 will be able to pick the assembly 1, 2 up and position it in a production machine. The complementary interfit of the formations 8 and 9 with the formations 33 and 34 allows the position of the shoe 2 to be set with great precision. The reader 29 will read what size the shoe is and whether it is for the right or left foot, so that the production process can be wholly automatic.

We claim:

1. In combination:
a last having
an insert shaped to fit within a shoe during its manufacture,
a stem projecting along an axis from the insert and formed with
radially oppositely projecting front and rear protrusions,
a radially open seat, and
a radially directed flat,
machine-readable indicia carried on the flat, and means releasably fixing the stem to the insert;
a rack having a formation complementarily engageable with the seat for holding and positioning the last and a shoe carried on the insert thereof in a predetermined position relative to the rack; and
a robot arm provide with
a gripper having front and rear jaws formed with respective recesses complementarily engageable with the protrusions and
means on the arm juxtaposable with the indicia on the flat of a last held by the gripper for reading such indicia.

2. The combination defined in claim 1 wherein the protrusions and recesses are formed substantially entirely of planar surfaces.

3. The combination defined in claim 1 wherein the protrusions and recesses are complementarily rounded.

4. The combination defined in claim 1, further comprising a stationary card on the flat carrying the indicia.

5. The combination defined in claim 1 wherein the seat and formation are formed substantially entirely of planar surfaces.

6. The combination defined in claim 1 wherein the stem is formed with an axially upwardly open hole.

* * * * *